US006464237B1

(12) United States Patent
Gracie

(10) Patent No.: US 6,464,237 B1
(45) Date of Patent: Oct. 15, 2002

(54) SNOWBOARD BINDING

(76) Inventor: Brian P. Gracie, 17 Thornlodge Drive, Waterdown Ontario (CA), L0R 2H3

( * ) Notice: Subject to any disclaimer, the term of this patent is extended or adjusted under 35 U.S.C. 154(b) by 15 days.

(21) Appl. No.: 09/791,218

(22) Filed: Feb. 23, 2001

(51) Int. Cl.[7] ..... A63C 9/081
(52) U.S. Cl. ..... 280/14.24; 280/618
(58) Field of Search ..... 280/617, 618, 280/14.21, 14.22, 14.24, 624

(56) References Cited

U.S. PATENT DOCUMENTS

| | | | | |
|---|---|---|---|---|
| 5,172,924 A | | 12/1992 | Barci | |
| D365,132 S | | 12/1995 | Sims | |
| 5,556,123 A | | 9/1996 | Fournier | |
| 5,692,765 A | * | 12/1997 | Laughlin | 280/14.22 |
| 5,722,680 A | | 3/1998 | Dodge | |
| 5,758,895 A | * | 6/1998 | Bumgarner | 280/607 |
| 5,820,155 A | | 10/1998 | Brisco | |
| 5,855,390 A | | 1/1999 | Hassell | |
| 5,909,886 A | * | 6/1999 | Tugutaka et al. | 280/14.22 |
| 5,915,721 A | | 6/1999 | Laughlin et al. | |
| 5,997,027 A | * | 12/1999 | Jungkind | 280/617 |
| 6,007,077 A | * | 12/1999 | Moe | 280/14.22 |
| 6,293,577 B1 | * | 9/2001 | Shields | 280/617 |

* cited by examiner

*Primary Examiner*—Avraham Lerner

(57) ABSTRACT

A snowboard binding for allowing a user to use a strap-in system with the convenience of a step-in system without reducing the flexibility of a boot. The snowboard binding includes a mounting assembly that includes a base plate and a mounting plate. The mounting plate is designed to be coupled to the snowboard, the base plate is rotatably mounted to the mounting plate. A heel member is coupled to the base plate and is designed for securing a heel of the foot of the user to the mounting assembly. A toe member is hingably coupled to the base plate, the toe member is designed for securing toes of the foot of the user to the mounting assembly. The toe member is slidably coupled to the heel member. The toe member has an ankle strap and an ankle buckle. The ankle strap and the ankle buckle is pivotally coupled proximal a first end of the toe member. The ankle strap is adjustably insertable into the ankle buckle, the ankle strap is designed to be extended around an ankle of the user. The toe member has a toe strap and a toe buckle. The toe strap and the toe buckle is pivotally coupled proximal to a second of the toe member. The toe strap is adjustably insertable into the toe buckle, the toe strap is designed to be extended over the toes of the user.

13 Claims, 3 Drawing Sheets

SNOWBOARD BINDING

BACKGROUND OF THE INVENTION

1. Field of the Invention

The present invention relates to snowboard bindings and more particularly pertains to a new snowboard binding for allowing a user to use a strap-in system with the convenience of a step-in system without reducing the flexibility of a boot.

2. Description of the Prior Art

The use of snowboard bindings is known in the prior art. More specifically, snowboard bindings heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,556,123; U.S. Pat. No. 5,722,680; U.S. Pat. No. 5,915,721; U.S. Pat. No. 5,855,390; U.S. Pat. No. 5,172,924; U.S. Pat. No. 5,820,155; and U.S. Pat. No. Des. 365,132.

While these devices fulfill their respective, particular objectives and requirements, the aforementioned patents do not disclose a new snowboard binding. The inventive device includes a mounting assembly that includes a base plate and a mounting plate. The mounting plate is designed to be coupled to the snowboard, the base plate is rotatably mounted to the mounting plate. A heel member is hingably coupled to the base plate, the heel member is designed for securing a heel of the foot of the user to the mounting assembly. A toe member is hingably coupled to the base plate, the toe member is designed for securing toes of the foot of the user to the mounting assembly. The toe member is slidably coupled to the heel member. The toe member has an ankle strap and an ankle buckle. The ankle strap and the ankle buckle is pivotally coupled proximal a first end of the toe member. The ankle strap is adjustably insertable into the ankle buckle, the ankle strap is designed to be extended around an ankle of the user. The toe member has a toe strap and a toe buckle. The toe strap and the toe buckle are pivotally coupled proximal to a second of the toe member. The toe strap is adjustably insertable into the toe buckle, the toe strap is designed to be extended over the toes of the user.

In these respects, the snowboard binding according to the present invention substantially departs from the conventional concepts and designs of the prior art, and in so doing provides an apparatus primarily developed for the purpose of allowing a user to use a strap-in system with the convenience of a step-in system without reducing the flexibility of a boot.

SUMMARY OF THE INVENTION

In view of the foregoing disadvantages inherent in the known types of snowboard bindings now present in the prior art, the present invention provides a new snowboard binding construction wherein the same can be utilized for allowing a user to use a strap-in system with the convenience of a step-in system without reducing the flexibility of a boot.

The general purpose of the present invention, which will be described subsequently in greater detail, is to provide a new snowboard binding apparatus and method which has many of the advantages of the snowboard bindings mentioned heretofore and many novel features that result in a new snowboard binding which is not anticipated, rendered obvious, suggested, or even implied by any of the prior art snowboard bindings, either alone or in any combination thereof.

To attain this, the present invention generally comprises a mounting assembly that includes a base plate and a mounting plate. The mounting plate is designed to be coupled to the snowboard, the base plate is rotatably mounted to the mounting plate. A heel member is hingably coupled to the base plate, the heel member is designed for securing a heel of the foot of the user to the mounting assembly. A toe member is hingably coupled to the base plate, the toe member is designed for securing toes of the foot of the user to the mounting assembly. The toe member is slidably coupled to the heel member. The toe member has an ankle strap and an ankle buckle. The ankle strap and the ankle buckle is pivotally coupled proximal a first end of the toe member. The ankle strap is adjustably insertable into the ankle buckle, the ankle strap is designed to be extended around an ankle of the user. The toe member has a toe strap and a toe buckle. The toe strap and the toe buckle are pivotally coupled proximal to a second of the toe member. The toe strap is adjustably insertable into the toe buckle, the toe strap is designed to be extended over the toes of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new snowboard binding apparatus and method which has many of the advantages of the snowboard bindings mentioned heretofore and many novel features that result in a new snowboard binding which is not anticipated, rendered obvious, suggested, or even implied by any of the prior art snowboard bindings, either alone or in any combination thereof.

It is another object of the present invention to provide a new snowboard binding which may be easily and efficiently manufactured and marketed.

It is a further object of the present invention to provide a new snowboard binding which is of a durable and reliable construction.

An even further object of the present invention is to provide a new snowboard binding which is susceptible of a low cost of manufacture with regard to both materials and labor, and which accordingly is then susceptible of low prices of sale to the consuming public, thereby making such snowboard binding economically available to the buying public.

Still yet another object of the present invention is to provide a new snowboard binding which provides in the apparatuses and methods of the prior art some of the advantages thereof, while simultaneously overcoming some of the disadvantages normally associated therewith.

Still another object of the present invention is to provide a new snowboard binding for allowing a user to use a strap-in system with the convenience of a step-in system without reducing the flexibility of a boot.

Yet another object of the present invention is to provide a new snowboard binding which includes a mounting assembly that includes a base plate and a mounting plate. The mounting plate is designed to be coupled to the snowboard, the base plate is rotatably mounted to the mounting plate. A heel member is hingably coupled to the base plate, the heel member is designed for securing a heel of the foot of the user to the mounting assembly. A toe member is hingably coupled to the base plate, the toe member is designed for securing toes of the foot of the user to the mounting assembly. The toe member is slidably coupled to the heel member. The toe member has an ankle strap and an ankle buckle. The ankle strap and the ankle buckle is pivotally coupled proximal a first end of the toe member. The ankle strap is adjustably insertable into the ankle buckle, the ankle strap is designed to be extended around an ankle of the user. The toe member has a toe strap and a toe buckle. The toe strap and the toe buckle are pivotally coupled proximal to a second of the toe member. The toe strap is adjustably insertable into the toe buckle, the toe strap is designed to be extended over the toes of the user.

Still another object of the present invention is that both the toe and ankle straps can remain in the same position so the same set-up is used each time without requiring adjustments.

Still yet another object of the present invention is to provide a new snowboard binding that allows a user to get off the lift and does not reduce flexibility and feel of a snowboard boot, requires less of a visual insertion of the boot than current step-ins, and more of a feel when locked in.

Even still another object of the present invention is to provide a new snowboard binding that is adaptable to any snowboard boot and in an emergency if a user can not release the lock you can undo the straps to release.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
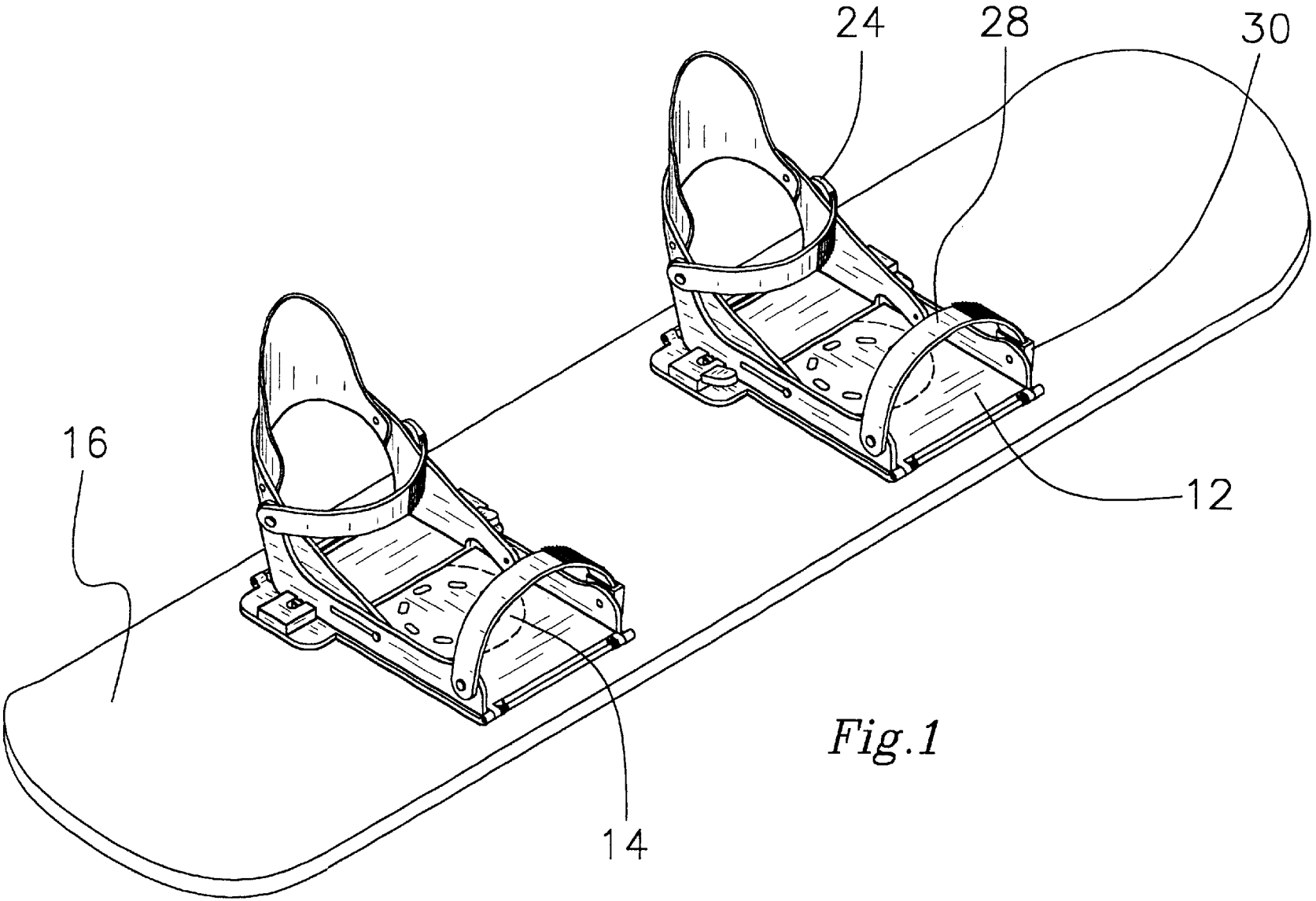
FIG. 1 is a perspective view of a new snowboard binding according to the present invention.
Figure 2:
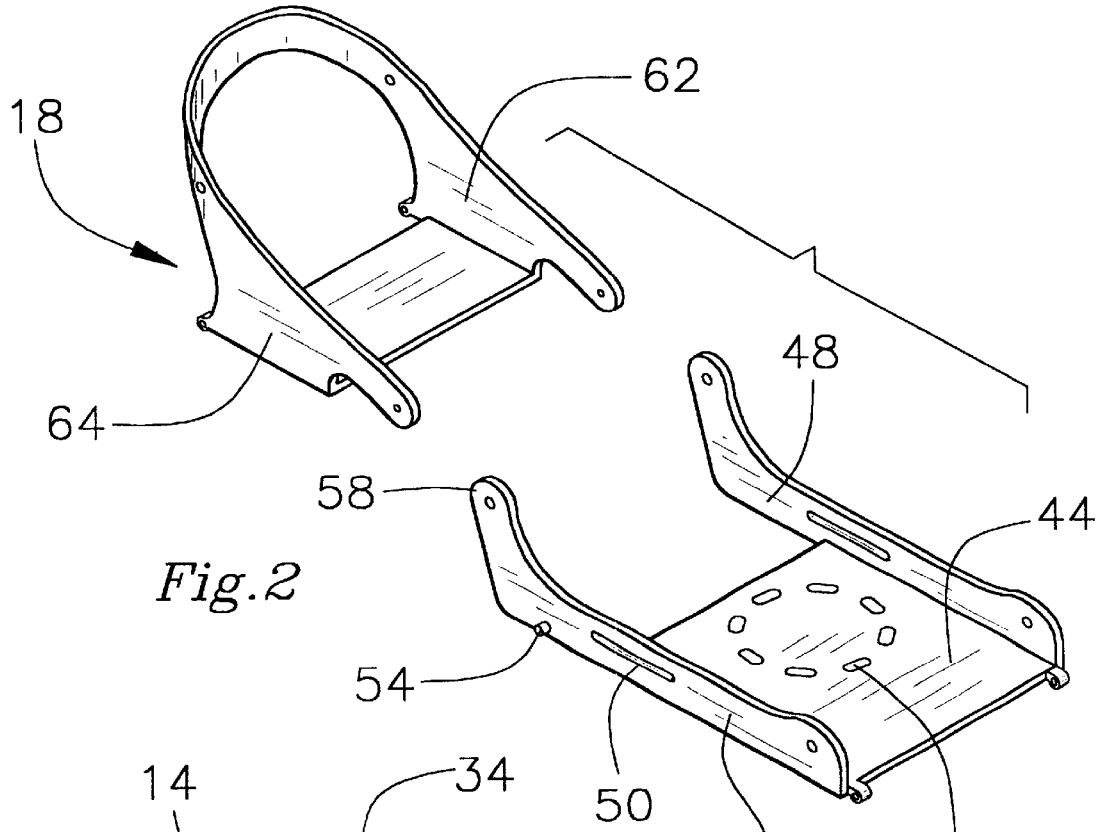
FIG. 2 is a perspective view of the present invention.
Figure 3:
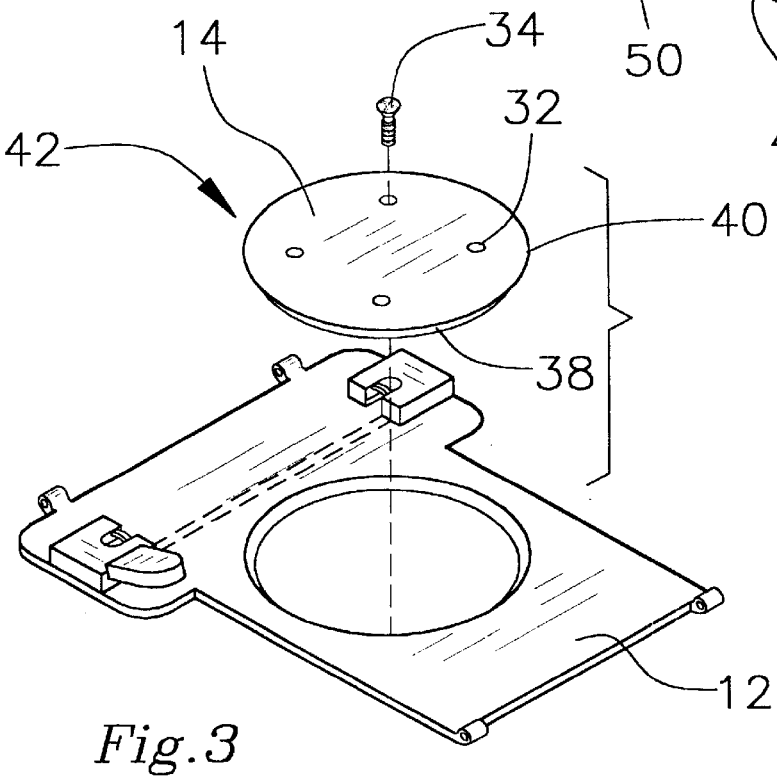
FIG. 3 is a perspective view of the present invention.
Figure 4:
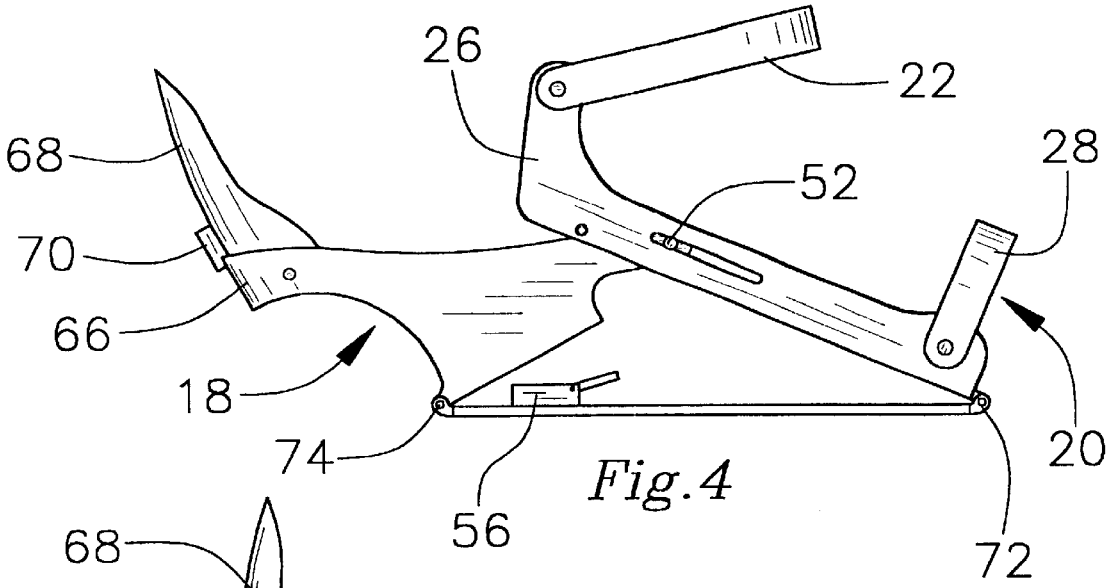
FIG. 4 is a side view of the present invention.
Figure 5:
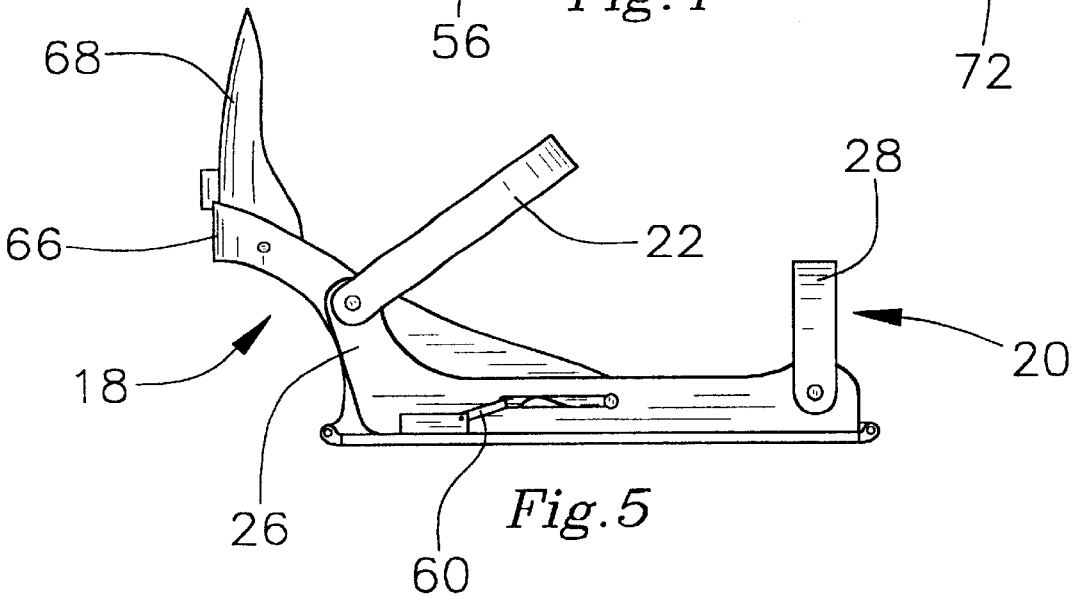
FIG. 5 is a side view of the present invention.
Figure 6:
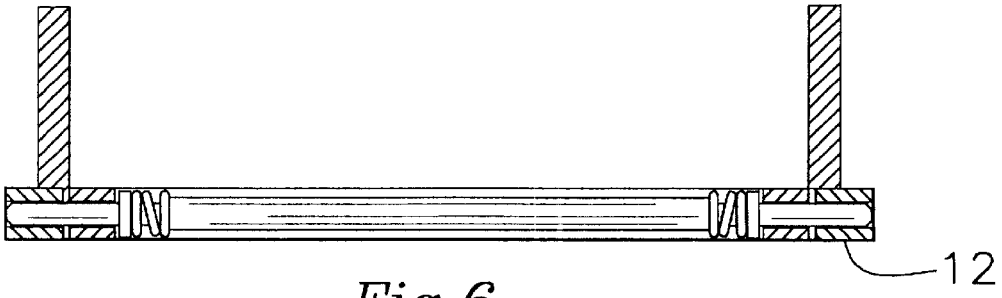
FIG. 6 is a cutaway view of the present invention.

With reference now to the drawings, and in particular to FIGS. 1 through 6 thereof, a new snowboard binding embodying the principles and concepts of the present invention and generally designated by the reference numeral 10 will be described.

As best illustrated in FIGS. 1 through 6, the snowboard binding 10 generally comprises a mounting assembly that includes a base plate 12 and a mounting plate 14. The mounting plate 14 is designed to be coupled to the snowboard 16, the base plate 12 is rotatably mounted to the mounting plate 14.

A heel member 18 is hingably coupled to the base plate 12, the heel member 18 is designed for securing a heel of the foot of the user to the mounting assembly.

A toe member 20 is hingably coupled to the base plate 12, the toe member 20 is designed for securing toes of the foot of the user to the mounting assembly. The toe member 20 is slidably coupled to the heel member 18. The toe member 20 has an ankle strap 22 and an ankle buckle 24. The ankle strap 22 and the ankle buckle 24 is pivotally coupled proximal a first end 26 of the toe member 20. The ankle strap 22 is adjustably insertable into the ankle buckle 24, the ankle strap 22 is designed to be extended around an ankle of the user.

The toe member 20 has a toe strap 28 and a toe buckle 30. The toe strap 28 and the toe buckle 30 are pivotally coupled proximal to a second of the toe member 20. The toe strap 28 is adjustably insertable into the toe buckle 30, the toe strap 28 is designed to be extended over the toes of the user.

The mounting plate 14 has a plurality of mounting apertures 32 through the mounting plate 14. A plurality of fasteners 34 extends through the mounting apertures 32 of the mounting plate 14. The fasteners 34 are designed for securing the mounting plate 14 to the snowboard 16.

The toe member 20 has a plurality of access apertures 36 that extends through the toe member 20. The access apertures 36 are for allowing access to the fasteners 34 when the toe member 20 abuts the base plate 12.

The mounting plate 14 has a beveled peripheral wall 38, the base plate 12 includes an opening defined by an outer peripheral wall 40 such that the outer peripheral wall 40 is complimentary to the beveled peripheral wall 38. The mounting member 42 maintains contact between the base plate 12 and the snowboard 16.

The toe member 20 has a toe plate 44, a first side wall 46 and a second sidewall 48. The first side wall 46 and the second side wall 48 extends upwardly from one of a pair of side edges of the toe plate 44. The first sidewall 46 and second sidewall 48 of the toe member 20 each includes a guide slot 50. The heel member 18 includes a pair guide pins 52 each is for slidably engaging a respect one of the guide slots 50 whereby pivoting of the toe member 20 in relation to the mounting member 42 thereby pivots the heel member 18 in relation to the mounting member 42.

The first side wall 46 and the second side wall 48 each have a locking pin 54, each of the locking pins 54 is for removably engaging a locking assembly 56 coupled the base plate 12 of the mounting member 42. Each of the locking pins 54 is located proximate the first end 58 of the toe member 20. One of the locking assemblies 56 includes a release lever 60 for selectively releasing each of the respective locking pins 54. The release lever 60 is coupled to the locking assembly 56 positioned proximate an inboard edge of the base plate 12.

The heel member 18 has a heel plate 62 and a pair of sidewalls 64. An ankle band 66 extends between the pair of sidewalls 64 such that the ankle band 66 is designed for supporting a rear of the ankle of the user. A support member 68 is positionably coupled to the ankle band 66 of the heel member 18, the support member 68 is designed for supporting the heel and ankle of the user.

An adjusting assembly 70 coupled between the support member 68 and the ankle band 66 such that the adjusting assembly 70 is for adjusting positioning of the support member 68 in relation to the ankle band 66 for providing varying degrees of support to the heel and the ankle of the user. A first biasing member 72 is coupled between the toe member 20 and the base plate 12 such that the first biasing member 72 urges the toe member 20 away from the base plate 12. A second biasing member 74 is coupled between the heel member 18 and the base plate 12 such that the second biasing member 74 urges the heel member 18 away from the base plate 12.

In use, a user slides the toe of the boot into the toe plate straps, then steps down causing the heel plate to rotate upward and close around the boot. A locking pin engages into the locking mechanism thereby securing the boot to the binding and thus to the board.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The locking mechanism shown is best suited for the present invention, however the present invention has been designed to accept any such mechanism, existing or future inventions and is therefore not limited to the mechanism as shown.

I claim:

1. A snowboard binding for securing a foot of a user to a snowboard, said snowboard binding comprising;

a mounting assembly having a base plate and a mounting plate, said mounting plate being adapted for coupling to the snowboard, said base plate being rotatably mounted to said mounting plate;

a heel member being hingably coupled to said base plate, said heel member being adapted for securing a heel of the foot of the user to said mounting assembly;

a toe member being hingably coupled to said base plate, said toe member being adapted for securing toes of the foot of the user to said mounting assembly, said toe member being slidably coupled to said heel member;

wherein said toe member has an ankle strap and an ankle buckle, said ankle strap and said ankle buckle being pivotally coupled proximal a first end of said toe member, said ankle strap being adjustably insertable into said ankle buckle, said ankle strap being adapted for extending around an ankle of the user;

wherein said toe member has a toe strap and a toe buckle, said toe strap and said toe buckle being pivotally coupled proximal to a second end of said toe member, said toe strap being adjustably insertable into said toe buckle, said toe strap being adapted for extending over the toes of the user; and wherein said toe member has a toe plate, a first side wall and a second side wall said first side wall and said second side wall being upwardly extending from one of a pair of side edges of said toe plate, said toe plate being hingably coupled to said base plate such that said toe plate is selectively pivotal to abut said base plate and said mounting plate when the foot of the user is inserted into said heel member and said toe member, said toe plate being for inhibiting twisting of said first side wall and said second side wall with respect to each other when the foot of the user is inserted into said toe member and said foot member.

2. The snowboard binding as set forth in claim 1, wherein said mounting plate has a plurality of mounting apertures through said mounting plate, a plurality of fasteners being for extending through said mounting apertures of said mounting plate, said fasteners being adapted for securing said mounting plate to the snowboard.

3. The snowboard binding as set forth in claim 2, wherein said toe member has a plurality of access apertures extending through said toe plate of said toe member, said access apertures being for allowing access to said fasteners when said toe member abuts said base plate.

4. The snowboard binding as set forth in claim 1, wherein said mounting plate has a beveled peripheral wall, said base plate having an opening defined by an outer peripheral wall such that said outer peripheral wall is complimentary to said beveled peripheral wall whereby said mounting member maintains contact between said base plate and the snowboard.

5. The snowboard binding as set forth in claim 1, wherein said first side wall and second side wall of said toe member each having a guide slot, said heel member having a pair guide pins each being for slidably engaging a respect one of said guide slots whereby pivoting of said toe member in relation to said mounting member thereby pivots said heel member in relation to said mounting member.

6. The snowboard binding as set forth in claim 5, wherein said first side wall and said second side wall each have a locking pin, each of said locking pins being for removably engaging a locking assembly coupled to, said base plate of said mounting member.

7. The snowboard binding as set forth in claim 6, wherein each of said locking pins is located proximate said first end of said toe member, one of said locking assembly having a release lever for selectively releasing each of said locking pins.

8. The snowboard binding as set forth in claim 7, wherein said release lever being coupled to said locking assembly positioned proximate an inboard edge of said base plate.

9. The snowboard binding as set forth in claim 1, wherein said heel member has a heel plate and a pair of side walls, an ankle band extending between said pair of side walls such that said ankle band is adapted for supporting a rear of the ankle of the user.

10. The snowboard binding as set forth in claim 9, further comprising:

a support member being positionably coupled to said ankle band of said heel member, said support member being adapted for supporting the heel and ankle of the user.

11. The snowboard binding as set forth in claim 10, further comprising:

an adjusting assembly coupled between said support member and said ankle band such that said adjusting assembly is for adjusting positioning of said support member in relation to said ankle band for providing varying degrees of support to the heel and the ankle of the user.

12. The snowboard binding as set forth in claim 1, further comprising:

a first biasing member being coupled between said toe member and said base plate such the said first biasing member urges said toe member away from said base plate;

a second biasing member being coupled between said heel member and said base plate such that said second biasing member urges said heel member away from said base plate.

13. A snowboard binding for securing a foot of a user to a snowboard, said snowboard binding comprising;

a mounting assembly having a base plate and a circular mounting plate, said mounting plate being adapted for coupling to the snowboard, said base plate being rotatably mounted to said mounting plate;

a heel member being hingably coupled to said base plate, said heel member being adapted for securing a heel of the foot of the user to said mounting assembly;

a toe member being hingably coupled to said base plate, said toe member being adapted for securing toes of the foot of the user to said mounting assembly, said toe member being slidably coupled to said heel member;

wherein said toe member has an ankle strap and an ankle buckle, said ankle strap and said ankle buckle being pivotally coupled proximal a first end of said toe member, said ankle strap being adjustably insertable into said ankle buckle, said ankle strap being adapted for extending around an ankle of the user;

wherein said toe member has a toe strap and a toe buckle, said toe strap and said toe buckle being pivotally coupled proximal to a second end of said toe member, said toe strap being adjustably insertable into said toe buckle, said toe strap being adapted for extending over the toes of the user;

wherein said mounting plate has a plurality of mounting apertures through said mounting plate, a plurality of fasteners being for extending through said mounting apertures of said mounting plate, said fasteners being adapted for securing said mounting plate to the snowboard;

wherein said toe member has a plurality of access apertures extending through said toe member, said access apertures being for allowing access to said fasteners when said toe member abuts said base plate;

wherein said mounting plate has a beveled peripheral wall, said base plate having an opening defined by an outer peripheral wall such that said outer peripheral wall is complimentary to said beveled peripheral wall whereby said mounting member maintains contact between said base plate and the snowboard;

wherein said toe member has a toe plate, a first side wall and a second side wall, said first side wall and said second side wall being upwardly extending from one of a pair of side edges of said toe plate, said toe plate being hingably coupled to said base plate such that said toe plate is selectively pivotal to abut said base plate and said mounting plate when the foot of the user is inserted into said heel member and said toe member, said toe plate being for inhibiting twisting of said first side wall and said second side wall with respect to each other when the foot of the user is inserted into said toe member and said foot member;

wherein said first side wall and second side wall of said toe member each having a guide slot, said heel member having a pair guide pins each being for slidably engaging a respect one of said guide slots whereby pivoting of said toe member in relation to said mounting member thereby pivots said heel member in relation to said mounting member;

wherein said first side wall and said second side wall each have a locking pin, each of said locking pins being for removably engaging a locking assembly coupled said base plate of said mounting member;

wherein each of said locking pins is located proximate said first end of said toe member, one of said locking assembly having a release lever for selectively releasing each of said respective locking pins;

wherein said release lever being coupled to said locking assembly positioned proximate an inboard edge of said base plate;

wherein said heel member has a heel plate and a pair of side walls, an ankle band extending between said pair of side walls such that said ankle band is adapted for supporting a rear of the ankle of the user;

a support member being positionably coupled to said ankle band of said heel member, said support member being adapted for supporting the heel and ankle of the user;

an adjusting assembly coupled between said support member and said ankle band such that said adjusting assembly is for adjusting positioning of said support member in relation to said ankle band for providing varying degrees of support to the heel and the ankle of the user;

a first biasing member being coupled between said toe member and said base plate such the said first biasing member urges said toe member away from said base plate; and a second biasing member being coupled between said heel member and said base plate such that said second biasing member urges said heel member away from said base plate.

* * * * *